US006327780B1

(12) United States Patent
Bigham et al.

(10) Patent No.: US 6,327,780 B1
(45) Date of Patent: Dec. 11, 2001

(54) SAFETY MECHANISM FOR PREVENTING ACCIDENTAL DEPLOYMENT OF A UTILITY KNIFE BLADE

(75) Inventors: Gregory Bigham, Hernando; Jon R. Conway, Olive Branch; Gary L. Lowery, Southhaven, all of MS (US)

(73) Assignee: Gregory L. Beyers, Bloomington, IN (US)

( * ) Notice: Subject to any disclaimer, the term of this patent is extended or adjusted under 35 U.S.C. 154(b) by 0 days.

(21) Appl. No.: 09/452,801

(22) Filed: Dec. 2, 1999

(51) Int. Cl.[7] ..... B26B 1/08
(52) U.S. Cl. ..... 30/162; 30/335
(58) Field of Search ..... 30/162, 335, 163

(56) References Cited

U.S. PATENT DOCUMENTS

| | | |
|---|---|---|
| D. 293,202 | 12/1987 | West et al. . |
| 1,493,620 | 5/1924 | Evers . |
| 2,145,985 | 2/1939 | Krajicek . |
| 2,736,960 | 3/1956 | Armstrong . |
| 3,557,637 | 1/1971 | Braginetz . |
| 3,660,896 | 5/1972 | Umholtz . |
| 3,708,881 | 1/1973 | Bennett . |
| 3,816,918 | 6/1974 | Brunty . |
| 4,524,518 | 6/1985 | West . |
| 4,578,865 | 4/1986 | Keller . |
| 4,586,256 | 5/1986 | Weimann . |
| 4,663,845 | 5/1987 | Weimann . |
| 4,744,146 | 5/1988 | Schmidt . |
| 4,953,293 | 9/1990 | Sterlacci . |
| 5,023,996 | 6/1991 | Pape et al. . |
| 5,093,994 | 3/1992 | Karas . |
| 5,214,852 | 6/1993 | Napolitano . |
| 5,230,152 | 7/1993 | Kennedy . |
| 5,282,316 | 2/1994 | Anderson . |
| 5,303,474 | 4/1994 | Keklak et al. . |
| 5,337,481 | 8/1994 | Mears . |
| 5,426,855 | 6/1995 | Keklak et al. . |
| 5,511,261 | 4/1996 | Collins . |
| 5,613,300 | 3/1997 | Schmidt . |
| 5,644,843 | 7/1997 | Young . |
| 5,890,294 | 4/1999 | Keklak et al. . |
| 5,960,544 * | 10/1999 | Beyers ..... 30/162 |

* cited by examiner

*Primary Examiner*—Douglas D. Watts
(74) *Attorney, Agent, or Firm*—Woodard, Emhardt, Naughton, Moriarty & McNett

(57) ABSTRACT

A safety mechanism for a utility knife, including a razor blade mounted in a blade holder slideably mounted in a blade chamber in the housing. The blade holder includes a tab protruding therefrom and is adapted to move between a retracted, blade-stowage position in the housing and a deployed position wherein the blade at least partially protrudes from the housing. The safety mechanism comprises a foreshortened safety channel adapted to engagingly receive the blade holder tab when the blade holder is retracted into the stowed position. The motion of the tab is restricted by the safety channel, thereby restricting the motion of the blade holder. The tab may be disengaged from the safety channel by simultaneously pushing it away from the deployed position and into the blade chamber. Once the tab is disengaged, the blade holder may be moved into the deployed position by pushing it towards the deployed position while maintaining the pushing force into the blade chamber.

10 Claims, 6 Drawing Sheets

SAFETY MECHANISM FOR PREVENTING ACCIDENTAL DEPLOYMENT OF A UTILITY KNIFE BLADE

TECHNICAL FIELD OF THE INVENTION

The present invention relates generally to the field of cutting tools, and more specifically to a safety mechanism for preventing the accidental deployment of a utility knife blade.

BACKGROUND OF THE INVENTION

Utility knives that incorporate retractable, replaceable razor blades are well known in the art. Utility knives are very versatile, enjoying popularity with the professional construction worker, the domestic handyman, and the amateur hobbyist alike. Utility knives generally include a retractable razor blade mounted within a protective handle or housing. The blade is fastened to a support structure such as a blade carrier or blade pusher, which extends through the surface of the housing. In operation, the blade is extended by sliding the blade holder forward. One deficiency of the prior art designs is that the blade may be inadvertently deployed, becoming a safety hazard. For example, if the blade holder catches on a pocket or a tool belt or is jostled by another tool in a toolbox, the blade may be deployed unbeknownst to the user. An unwary user reaching for a utility knife with the blade deployed can easily receive a severe cut.

There have been attempts in the prior art to address this problem. For example, U.S. Pat. No. 5,890,294 to Keklak et al. discloses a locking safety utility knife having an operating lever that deploys a blade when squeezed and a ratchet-like locking mechanism releasable by manipulation (depression) of a cam located at the end of the knife. However, the Keklak et al. device still exhibits the problem of accidental disengagement of the safety if the cam is accidentally depressed, allowing the knife to accidentally open and deploy the blade. Moreover, the cam is located on the end of the knife, increasing the likelihood of accidental depression.

Other known utility knives known in the art have sliding blades that are locked by blade holders that must be depressed as they are slid forward to engage the blade. Again, since the unlocking force and the deploying force may be resolved into a single angular force acting upon the blade holder, accidental release of the blade can readily occur if the blade holder catches on the user's clothing or on another tool.

There is therefore a need in the art for a safety mechanism for a utility knife that cannot be accidentally disengaged through the simple depression of a switch or cam. The present invention satisfies this need.

SUMMARY OF THE INVENTION

The present invention relates to a safety mechanism for a utility knife. The utility knife includes a knife blade mounted in a blade holder that may move between a retracted, blade-stowage position in the housing and a deployed position wherein the blade at least partially protrudes from the housing. The blade holder includes an actuating lever portion protruding from the housing. In one embodiment, a narrow channel is formed in the knife housing through which a tab connected to the blade holder may travel. The channel is foreshortened, such that the tab cannot travel far enough to allow the blade holder to move into the deployed position. The tab is biased to enter the channel when the blade holder is moved into a retracted position, and may only be disengaged by moving the actuating lever in the opposite direction of the deployed position, while simultaneously depressing the actuating lever. The blade may then be deployed by moving the still-depressed actuating lever towards the deployed position.

One object of the present invention is to provide an improved utility knife. Related objects and advantages of the present invention will be apparent from the following description.

DETAILED DESCRIPTION OF THE PREFERRED EMBODIMENT

Figure 1:
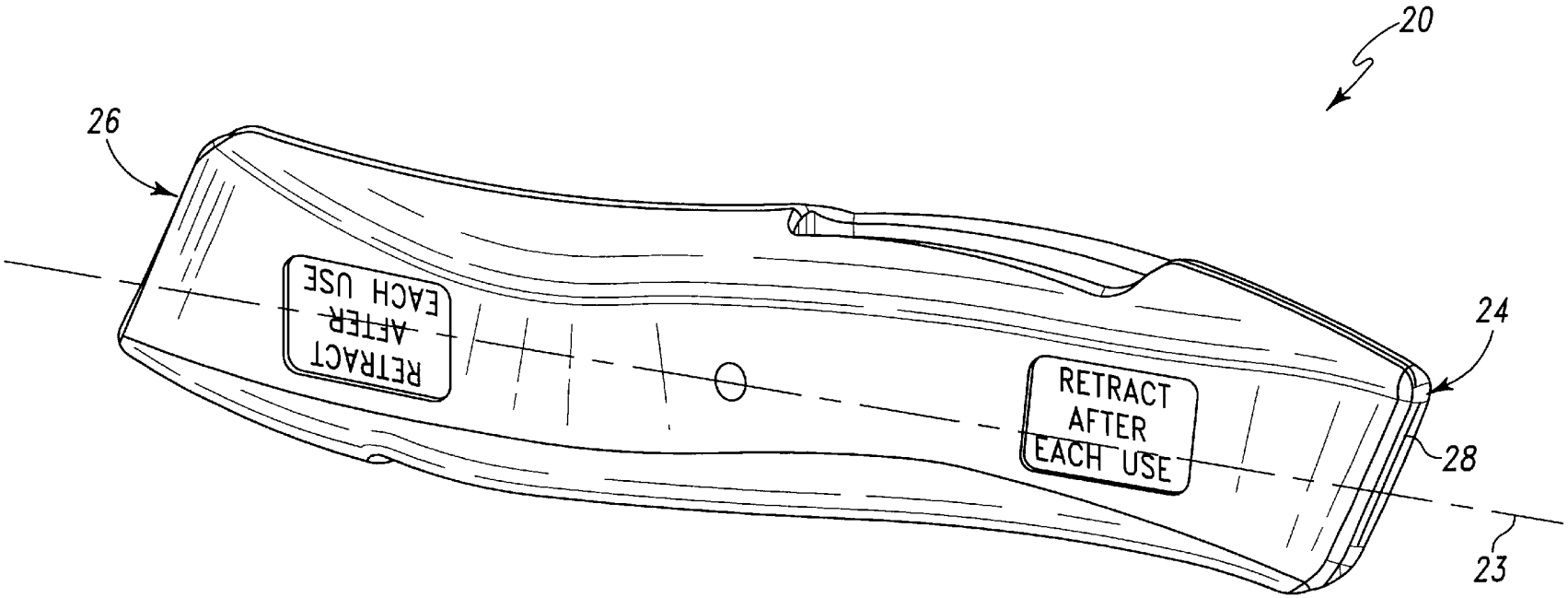
FIG. 1 is a perspective view of the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
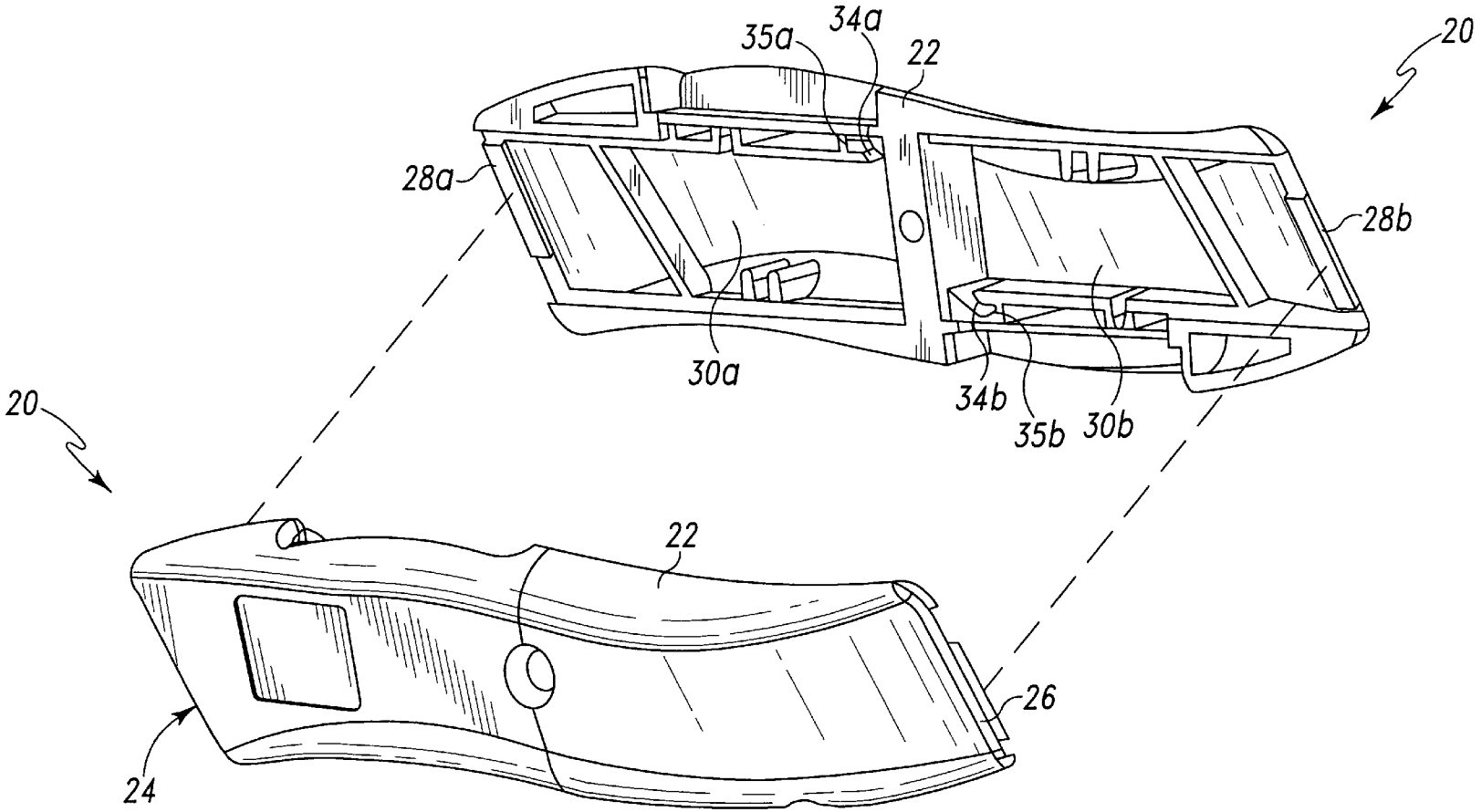
FIG. 2 is an exploded side perspective view of the embodiment of FIG. 1.

Referring now to FIG. 1, there is illustrated a first embodiment of the present invention, indicated generally at 20. With reference to FIG. 2, the utility knife 20 includes a housing having an anterior end 24 and a posterior end 26. Preferably, the housing 20 has 180-degree rotational symmetry about a midpoint 25. In other words, the preferred embodiment is a double-acting utility knife 20 adapted to deploy a razor blade from either end 24, 26, embodiments having different numbers of blades are likewise contemplated.

Referring now to FIG. 2, the anterior and posterior ends 24, 26 of the preferred embodiment have apertures 28*a–b* formed therein. The apertures 28 *a–b* are preferably slots, although they may have any convenient configuration. Chambers 30*a–b* are formed in the housing, each adapted to receive a blade holder 32 (see FIGS. 3 and 4*a–c*). Safety channels 34*a–b* are also formed in the housing adjacent the blade chambers 30*a–b*. Safety channels 34*a–b* are formed extending respectively from end walls 35*a–b* and open respectively into blade chambers 30*a–b*. A razor blade (illustrated in phantom at 36 in FIGS. 3 and 4*a–c*) may be removably coupled to each blade holder 32.

Figure 3:
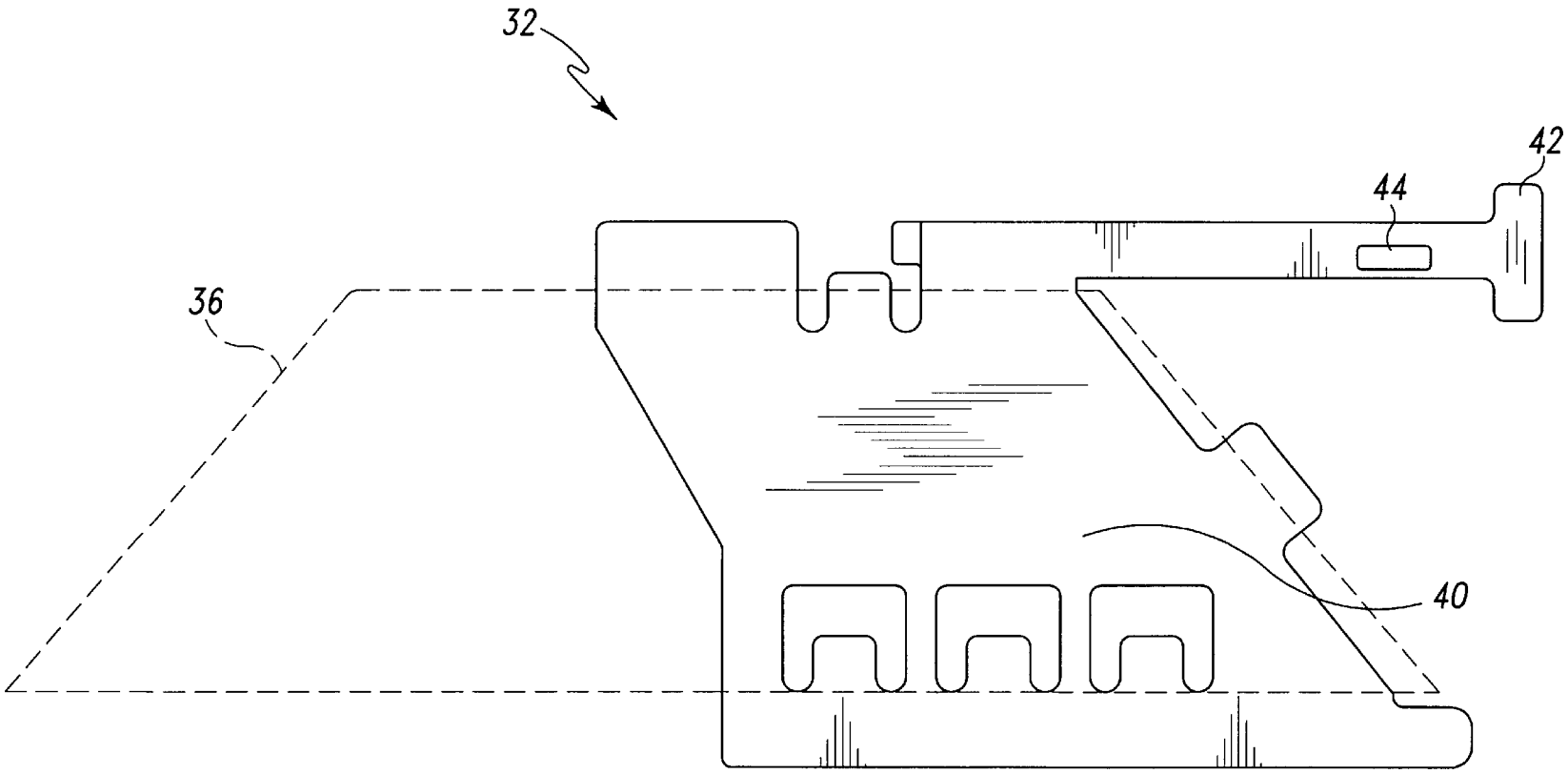
FIG. 3 is a side elevational view of the blade holder of the embodiment of FIG. 1.

FIG. 3 illustrates blade holder 32. Blade holder 32 is adapted to hold a razor blade 36 in the blade-engaging portion 40, while actuating lever portion 42 extends out above the blade-engaging portion 40. Blade holder 32 also includes a tab or safety-channel engaging portion 44, which preferably extends at a substantially 90-degree angle from actuating lever portion 42. Safety channel engaging portion 44 is adapted to slidingly engage one of the safety channels 34*a–b* when blade holder 32 is operationally positioned in housing 22.

Figure 4A:
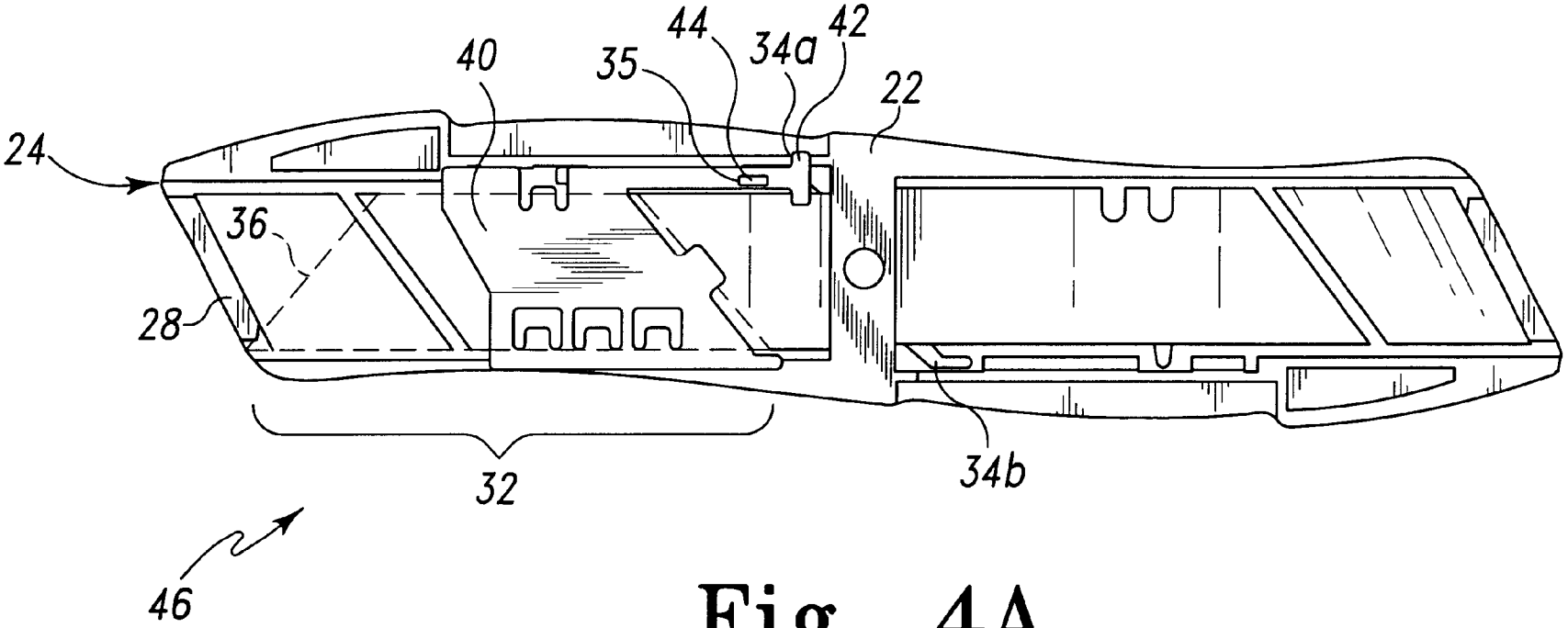
FIG. 4*a* is a side sectional view of the embodiment of FIG. 1 with the blade recessed and locked.
Figure 4B:
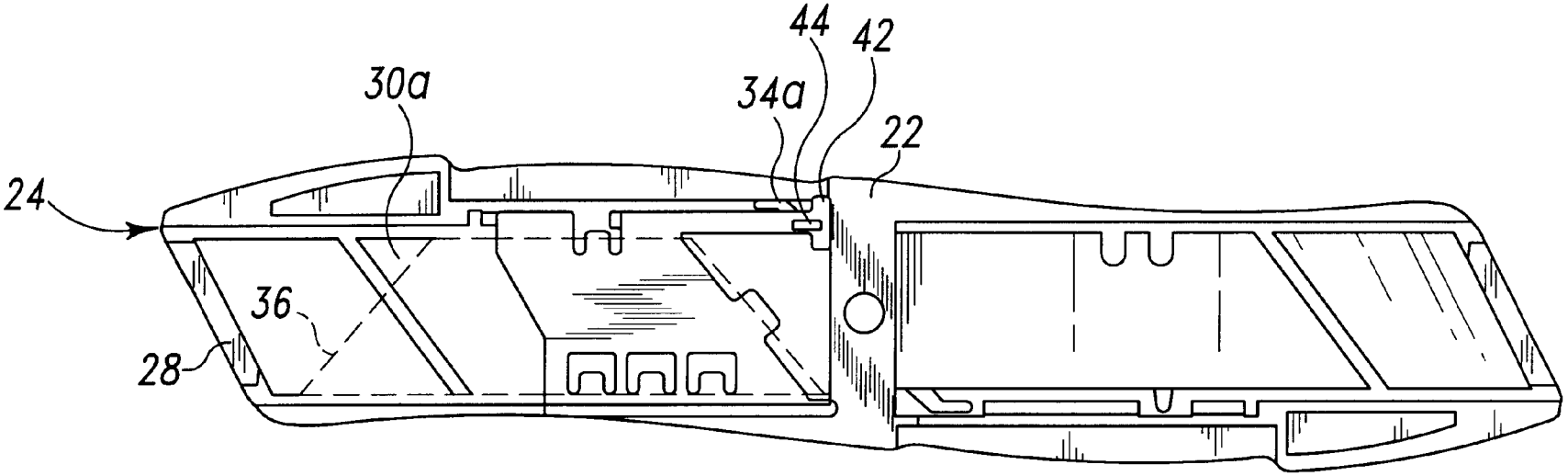
FIG. 4*b* is a side sectional view of the embodiment of FIG. 1 with the blade recessed and unlocked.
Figure 4C:
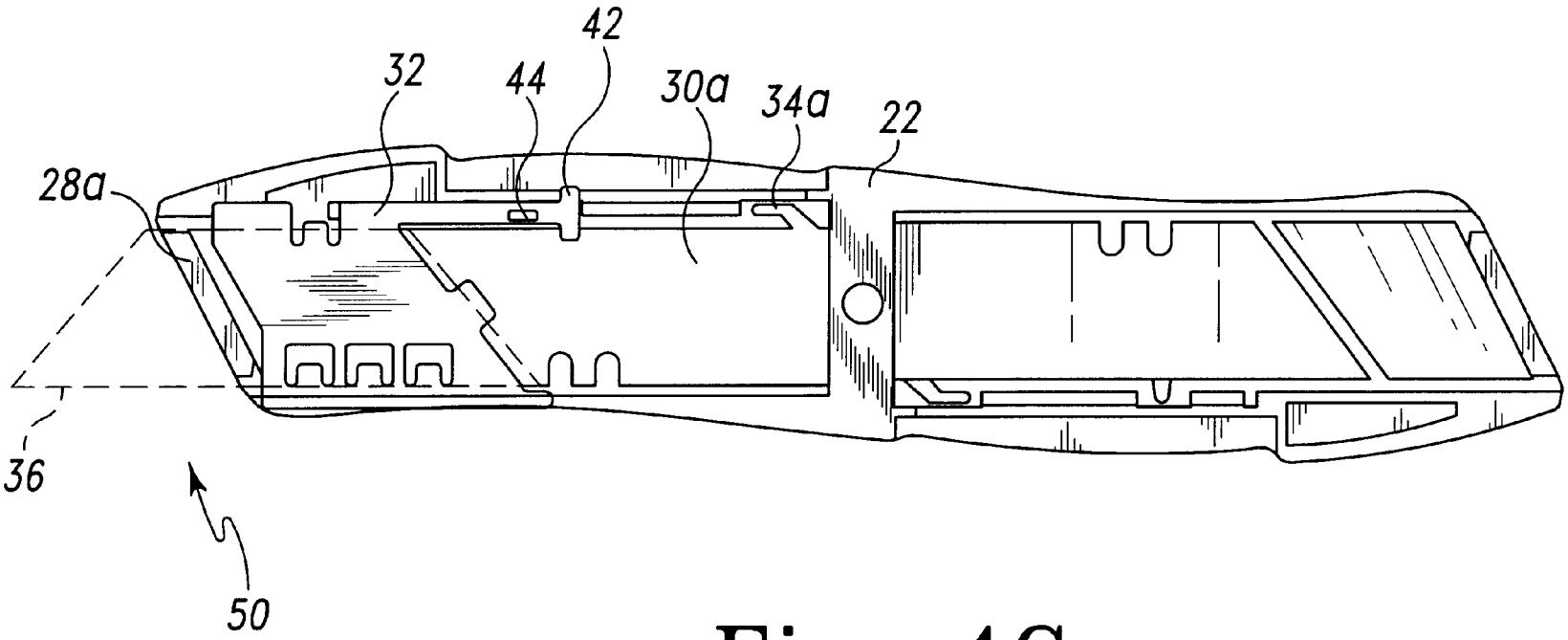
FIG. 4*c* is a side sectional view of the embodiment of FIG. 1 with the blade deployed.

FIGS. 4*a–c* illustrate blade holder 32 slidingly positioned in housing 22 and in which a blade 36 has been operationally coupled. While FIGS. 4*a–c* detail a blade holder 32 positioned to deploy a blade 36 from the anterior end 24 of utility knife 20, it is understood that the illustrated process equally applies through symmetry to a blade deployed from the posterior end 26. FIG. 4*a* illustrates blade holder 32 occupying recessed position 46, with safety channel engaging portion 44 slidingly engaged in safety channel 34*a*. Blade holder 32 is prevented from moving towards anterior end 24 (and blade 36 is prevented from exiting slot 28*a*) by the end wall 35*a* of safety channel 34*a* lockingly engaging safety channel engaging portion 44.

FIG. 4*b* illustrates blade holder 32 being disengaged from safety channel 34*a*. A disengaging force vector acts on blade holder 32 such that channel engaging portion 44 is slid away from end wall 35*a*, down safety channel 34*a*, and into blade chamber 30*a*, thus releasing blade holder 32 and enabling blade holder 32 and held blade (illustrated in phantom at 36) for deployment.

As is shown in FIG. 4*c*, blade 36 is deployed by sliding blade holder 32 towards anterior end 24 of utility knife 20 while maintaining sufficient force on the safety channel engaging portion 44 (by depressing actuating lever portion 42) to prevent it from re-engaging safety channel 34*a*. Blade (illustrated in phantom at 36) in deployed position 50 partially extends through slot 28*a*.

Blade holder 32 is preferably formed from spring steel, but may be made of any material that will exert a biasing force against deformation. The spring steel exerts a biasing force on tab 44, pushing it into channel 34*a* as soon as it is aligned with channel 34*a*. Tab 44 must be pushed against the biasing force to remove tab 44 from channel 34*a* in order for the blade to be deployed.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A safety mechanism for a utility knife comprising:

an elongated housing having an apertured anterior end and an apertured posterior end;

a blade chamber formed within the housing and aligned with the anterior aperture;

a safety channel formed within the housing and oriented substantially parallel to the blade chamber;

a blade holder slideably mounted in the housing and having a blade-engaging portion slideably positioned in the blade chamber, an actuating lever portion operationally coupled to the blade-engaging portion and extending out of the housing, and a safety channel engaging portion connected to the actuating lever portion and adapted to engage the safety channel;

a blade mounted in the blade-engaging portion of the blade holder;

wherein the blade holder is adapted to slide along a longitudinal axis between a recessed position wherein the blade is completely within the housing and a deployed position wherein the blade extends partially outside of the housing;

wherein the safety channel is foreshortened and adapted to releasably engage the safety engaging portion of the blade holder when the blade holder is in the recessed position;

wherein the safety channel is further adapted to prevent the forward motion of an engaged safety channel engaging portion; and wherein the blade holder must simultaneously be pushed into the housing and towards the posterior end to release the safety channel engaging portion from the safety channel and enable the blade holder to move into the deployed position.

2. The safety mechanism of claim 1 wherein the aperture is a slit.

3. The safety mechanism of claim 1 wherein once the safety engaging portion of the blade holder is released, the blade holder must remain pushed into the housing while it is slid forward to deploy the blade.

4. The safety mechanism of claim 1 wherein the blade holder is positively biased into the safety channel.

5. The safety mechanism of claim 4 further comprising a spring adapted to bias the blade holder into the safety channel.

6. A safety mechanism for a utility knife comprising:

an elongated housing having an apertured anterior end and an apertured posterior end;

an anterior blade chamber formed within the anterior end of the housing and aligned with the anterior aperture;

a posterior blade chamber formed within the posterior end of the housing and aligned with the posterior aperture;

an anterior safety chamber formed within the housing and oriented substantially parallel to the anterior blade chamber;

a posterior safety chamber formed within the housing and oriented substantially parallel to the posterior blade chamber;

an anterior blade holder slideably mounted in the housing and having an anterior blade-engaging portion positioned in the anterior blade chamber, an anterior actuating lever portion operationally coupled to the anterior blade-engaging portion and extending through the housing, and an anterior safety chamber engaging portion connected to the anterior actuating lever portion and adapted to engage the anterior safety chamber;

a posterior blade holder slideably mounted in the housing and having a posterior blade-engaging portion positioned in the posterior blade chamber, a posterior actuating lever portion operationally coupled to the posterior blade-engaging portion, and a posterior safety chamber engaging portion connected to the posterior actuating lever portion and adapted to engage the posterior safety chamber;

an anterior blade mounted in the anterior blade holder;

a posterior blade mounted in the posterior blade holder;

wherein the posterior blade holder is adapted to move between a recessed position wherein the posterior blade is completely within the housing and a deployed position wherein the posterior blade extends partially outside of the housing;

wherein the anterior blade holder is adapted to move between a recessed position wherein the anterior blade is completely within the housing and a deployed position wherein the anterior blade extends partially outside of the housing;

wherein the anterior and posterior safety chambers are foreshortened and adapted to releasably engage the respective anterior and posterior safety engaging portion of the respective anterior and posterior blade holders when the respective anterior and posterior blade holders are in the recessed positions;

wherein the respective anterior and posterior safety chambers are further adapted to prevent motion towards the respective anterior and posterior ends of the respective anterior and posterior engaged safety engaging portions;

wherein the respective anterior and posterior blade holders must be pushed into the housing and away from the respective anterior and posterior apertures to release the respective anterior and posterior safety engaging portions from the respective anterior and posterior safety chambers, enabling the respective anterior and posterior blade holders to move into the deployed positions.

7. A safety mechanism for a utility blade comprising:

an elongated housing having an aperture formed therein;

a blade chamber formed within the housing;

a safety channel formed within the housing and in communication with the blade chamber; and a tabbed blade holder slideably mounted in the housing and adapted to slide between a recessed position and a deployed position;

wherein the tab is biased to engage the safety channel when the blade holder is moved into the recessed position; and wherein the blade holder must be moved toward the recessed position and the tab must be pushed into the blade chamber before the blade holder can be pushed into the deployed position.

8. The safety mechanism of claim 7 wherein the blade holder is positively biased into the safety chamber.

9. A method of preventing accidental deployment of a blade of a utility knife, comprising the steps of:

providing a utility knife having a blade holder slideably mounted in a housing and adapted to move between a blade recessed position and a blade deployed position;

providing a safety channel having an end wall formed in the housing;

providing a safety channel engaging tab connected to the blade holder and adapted to engage the safety channel when in the blade recessed position;

moving the blade holder into a recessed position;

receiving the tab in the safety channel; and moving the tab to engage the safety channel end wall.

10. The method of claim 9 further comprising the steps of:

sliding the tab away from the end wall;

applying a force to push the tab from the safety channel into the blade chamber; and maintaining the pushing force on the tab while sliding the blade holder into the blade deploying position.

* * * * *